US006925932B2

(12) United States Patent
Schneider et al.

(10) Patent No.: US 6,925,932 B2
(45) Date of Patent: Aug. 9, 2005

(54) COMBINED PRINTING MACHINE

(75) Inventors: Josef Schneider, Diedorf-Lettenbach (DE); Peer Dilling, Friedberg (DE)

(73) Assignee: Man Roland Druckmaschinen AG, Offenbach (DE)

( * ) Notice: Subject to any disclaimer, the term of this patent is extended or adjusted under 35 U.S.C. 154(b) by 0 days.

(21) Appl. No.: 10/276,384

(22) PCT Filed: Apr. 28, 2001

(86) PCT No.: PCT/EP01/04801

§ 371 (c)(1),
(2), (4) Date: Apr. 16, 2003

(87) PCT Pub. No.: WO01/87610

PCT Pub. Date: Nov. 22, 2001

(65) Prior Publication Data

US 2003/0221568 A1 Dec. 4, 2003

(30) Foreign Application Priority Data

May 16, 2000 (DE) ..... 100 23 689

(51) Int. Cl.[7] ..... B41F 13/24
(52) U.S. Cl. ..... 101/232; 101/183
(58) Field of Search ..... 101/177, 180, 101/181, 182, 183, 184, 185, 217, 218, 228, 232, 247

(56) References Cited

U.S. PATENT DOCUMENTS

| | | | | |
|---|---|---|---|---|
| 1,691,021 A | | 11/1928 | Campbell | |
| 3,660,203 A | * | 5/1972 | Beck et al. | 156/384 |
| 3,987,884 A | * | 10/1976 | Buxton | 400/61 |
| 4,145,039 A | | 3/1979 | Carlsson | |
| 4,369,705 A | * | 1/1983 | Gelinas | 101/177 |
| 4,419,613 A | | 12/1983 | Ichinose et al. | |
| 4,711,172 A | | 12/1987 | Capdebosc | |
| 4,747,347 A | * | 5/1988 | McAnelly | 101/227 |
| 5,562,032 A | | 10/1996 | Hasegawa | |

FOREIGN PATENT DOCUMENTS

| | | |
|---|---|---|
| DE | 587 513 C | 11/1933 |
| DE | 27 41 108 A1 | 3/1978 |
| DE | 44 43 031 A1 | 6/1995 |
| DE | 199 21 271 A1 | 12/1999 |
| FR | 2 585 287 | 1/1987 |

* cited by examiner

*Primary Examiner*—Ren Yan
(74) *Attorney, Agent, or Firm*—Leydig, Voit & Mayer, Ltd.

(57) ABSTRACT

A printing machine for multicolor printing which includes a plurality of printing units and a system for transporting and guiding either sheet-type or web-type printable matter through the printing units. The guiding system includes means, such as adhesive, contact pressure, or retaining belts, for maintaining the printable matter on a transfer belt in proper registry during transfer through the successive printing units.

12 Claims, 5 Drawing Sheets

Prior Art

COMBINED PRINTING MACHINE

FIELD OF THE INVENTION

The present invention relates generally to multicolor printing machines, and more particularly, to a system for guiding and transporting printable matter through a plurality of printing units of such printing machines.

BACKGROUND OF THE INVENTION

PRIOR ART

In printing machines for various printing methods, it is common practice to provide sheet transport means that allow a linear transport of substrates to be printed through the printing units from the feed station to the delivery station. Some of these methods and devices utilize grippers. Other methods and devices utilize conveyor belts that are linearly guided through the printing units for transporting the sheet-like materials.

DE 19527264 A1 discloses a printing machine with a linear substrate guide. In this case, the transport path of the substrates should extend linearly from the feed stack to the transport means in the plane of the transport path through the printing units. A conveyor belt is provided which transports the substrates between the cylinders of the printing units, e.g., by means of a frictional engagement. However, this publication contains no information regarding retention of the sheets on the conveyor belt with correct registration.

DE 19921271 A1 discloses a method for transporting sheets through a printing machine, as well as a device for carrying out said method. In this case, instead of grippers, regions that are coated with an adhesive are provided on the sheet guiding elements, with said adhesive-coated regions making it possible to guide the sheets while they are secured in position. This publication also describes a printing machine in which printable matter is linearly transported through the printing machine by means of a conveyor belt. This publication also contains a reference to the fact that retention of the sheet by means of electrostatic charges is not sufficient for transport of the sheets.

The present invention aims to develop a variable transport device that can be used in different printing machines. In addition, a holding device for the printable matter need be provided that makes it possible to always realizing the same conditions for transport of the printable matter.

OBJECTS AND SUMMARY OF THE INVENTION

It is an object of the present invention to provide a versatile printable matter transport system that can be used in different types of printing machines.

Another object is to provide a printing machine having a sheet transport and guiding system which maintains the printable matter in proper condition for transport and printing through a multiplicity of printing units.

A further object is to provide a printing machine as characterized above in which printable matter can be linearly transferred through a plurality of printing units without the use of mechanical grippers.

The foregoing objects are attained by a machine configuration that is adaptable for reliably transporting printable matter that may vary broadly with respect to shape, size, and material composition. In this case, renewable holding regions preferably are provided on a conveyor belt as the holding means for sheet-like printable matter. This makes it possible to always realize the same conditions for all sheets to be transported through the printing machine. In addition, it is no longer necessary to generate electrostatic charges. The device also is suitable for various types of printable matter. Advantageous embodiments of the invention include holding means in the form of adhesive films, melt-on adhesive regions, variably applicable adhesive strips, offset pressing devices, rolling devices, or timed transport movements of the rollers.

Other objects and advantages of the invention will become apparent upon reading the following detailed description and upon reference to the drawings, in which:

Figure 1:
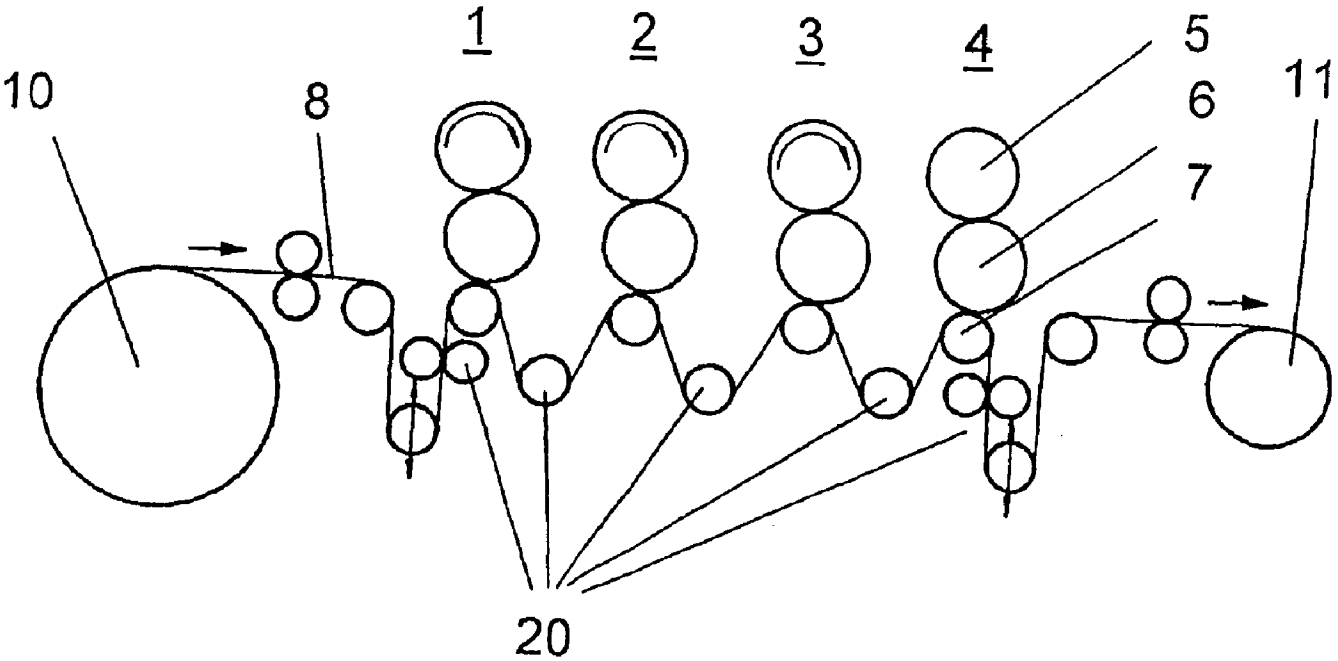
FIG. 1 is a partially diagrammatic depiction of a web-fed rotary printing machine with which sheet conveying systems in accordance with the invention may be used.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DETAILED DESCRIPTION OF THE PREFERRED EMBODIMENTS

Referring now more particularly to FIG. 1, there is shown a web-fed rotary printing machine with several printing units 1–4, the basic configuration of which comprises an impression cylinder 7, a blanket cylinder 6 and a plate cylinder 5. The web 8 of printable matter is unwound from a supply roll 10 and transported to the impression cylinder 7 of the printing unit 1, with the web being printed in this printing unit by means of the blanket cylinder 6 and then transported to the next printing unit 2 via a deflection roller 20. This process continues similarly until all print images are printed on the web in the printing units 1–4. In the described embodiment, the web 8 of printable matter is transported to a take-off roller 11 and wound up again.

While the described printing machine is an offset printing machine it does not contain so-called blanket-to-blanket printing units. In this case, each printing unit 1–4 is respectively provided with an impression cylinder 7 that merely serves to press the printable matter against the printing cylinder, in this case, the blanket cylinder 6. Such a configuration of a web-fed rotary printing machine is relatively simple in contrast to printing units that normally are equipped for a double-sided printing process. For reasons of simplicity, the impression cylinders 7 have a smaller diameter than the blanket cylinders 6 and the plate cylinders 5. This is possible because each impression cylinder 7 merely serves a support function. The proper registration of the print images in the various printing units 1–4 can be achieved with the aid of deflection rollers 20 or other devices, e.g., so-called web tensioning devices, which preferably are appropriately mounted for adjustable positioning.

Figure 2:
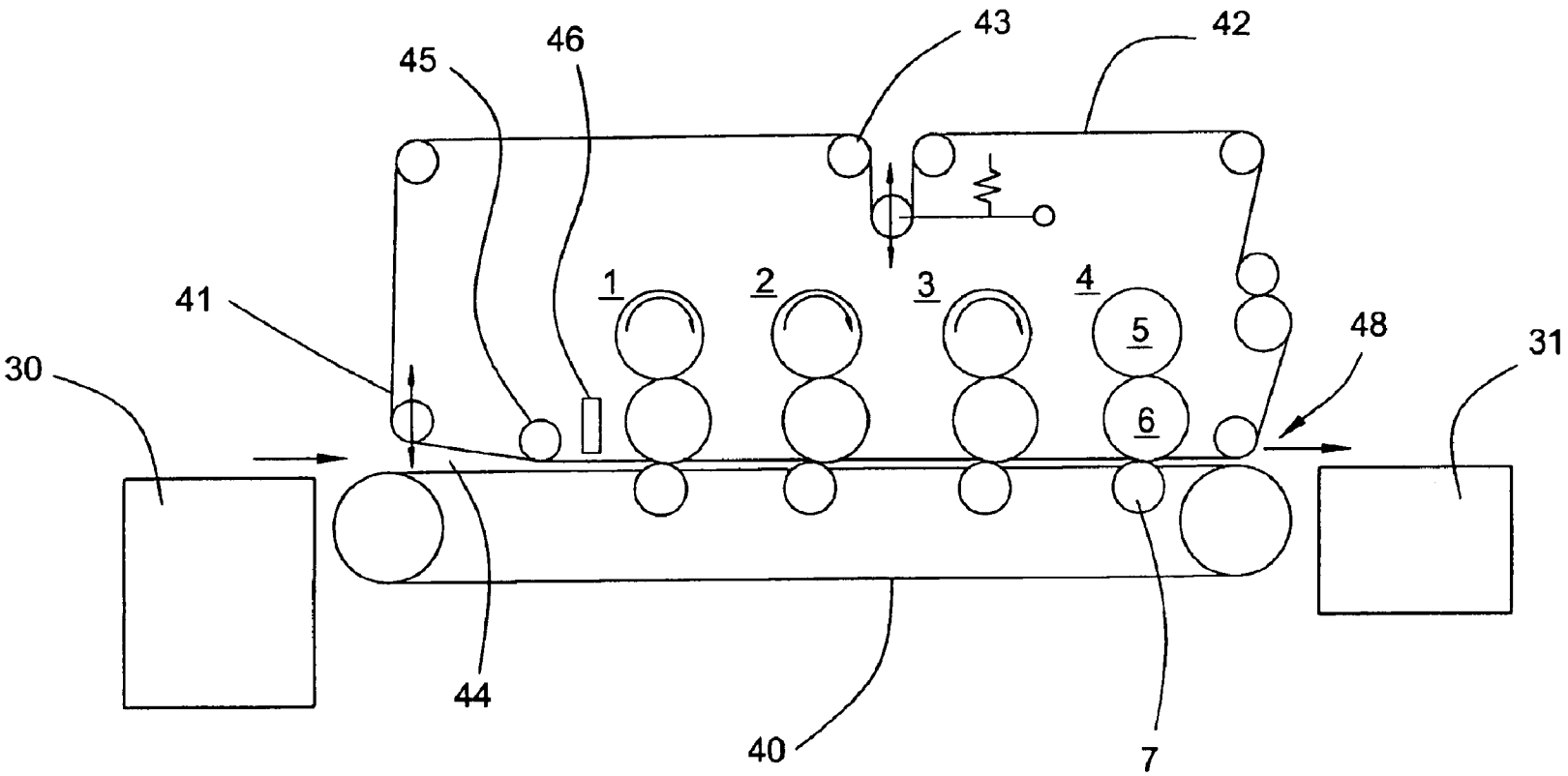
FIG. 2 is diagrammatic depiction of a printing machine of a similar configuration as that shown in FIG. 1 with a conveyor belt and holding band printable matter transfer and guiding system in accordance with the invention.

FIG. 2 shows a printing machine that has the same basic configuration as that shown in FIG. 1. In this case, a known type of conveyor belt 40 for printable matter is guided over the region of the impression cylinders 7. The conveyor belt 40 extends along a plane path through the printing zones of all printing units 1–4, namely between the respective blanket cylinders 6 and the impression cylinders 7. Printable matter in the form of webs or sheets can be laced on this conve or belt 40.

Sheets of printable matter are fed to the conveyor belt 40 from a feed station 41 arranged in front of the printing unit 1, with said sheets being removed from the feed stack by means of a sheet feeder 30. The sheets are removed from the conveyor belt 40 at a delivery station 48 and placed onto a stack by means of a sheet delivery mechanism 31. The sheets of printable matter are held on the conveyor belt 40 with suitable means while they pass through the printing zones of the printing units 1–4.

Webs of printable matter can be processed similarly. When printing a web of printable matter by means of one-sided printing units, e.g., as in the embodiment shown, problems in guiding the printable matter may arise because the printable matter only adheres to a printing cylinder with one side in the printing zone. This problem can be eliminated by providing a suitable guide on the conveyor belt 40.

In FIG. 2, the printable matter is held on the conveyor belt 40 by means of holding bands 42. For this purpose, the conveyor belt 40 and the holding bands 42 are guided parallel to one another in the region in which the printable matter passes through the printing units. The holding bands 42 are returned above the printing units 1–4, in a closed circuit. Tensioning devices 43 may be provided in the region of the holding bands 42. The printable matter is transported by providing a timed catch roller for the holding bands 42 that can be moved in the vertical direction at the beginning of the conveyor belt 40. This makes it possible to produce an inlet gap 44 at the feed station 41 for the printable matter to be transported such that the printable matter can be inserted between the holding bands 42 and the conveyor belt 40 in a controlled and adjustable fashion. After the printable matter is inserted sufficiently far, the holding bands 42 are lowered and take hold of the printable matter such that it is held onto and transported along with the conveyor belt 40 due to the frictional engagement. A guide roller 45 arranged at the end of the inlet gap 44 feeds the printable matter to the conveyor belt 40 correctly and places the printable matter on the conveyor belt 40 such that it can be printed. The holding band or the holding bands 42 can be in the form of magnetic bands. These magnetic bands cooperate with corresponding counter surfaces of the conveyor belt 40. A secure frictional engagement between the printable matter and the conveyor belt 40 is achieved in this fashion. The printable matter is fixed on the conveyor belt 40 and can then be safely guided through the printing units 1–4 along a straight and planar transport path. The rollers 41,45 preferably are appropriately mounted for relative movement to each other, either linearly relative to each other or for movement for defining an arc.

A station 46 is provided in order to influence the transport of the printable matter. This station can be in the form of a measuring device and/or aligning device 46 or in the form of an electrostatic device. The position of the printable matter is detected at this station with the printable matter being aligned or electrostatically charged or discharged. All of these measures promote an orderly printing process.

Figure 5:
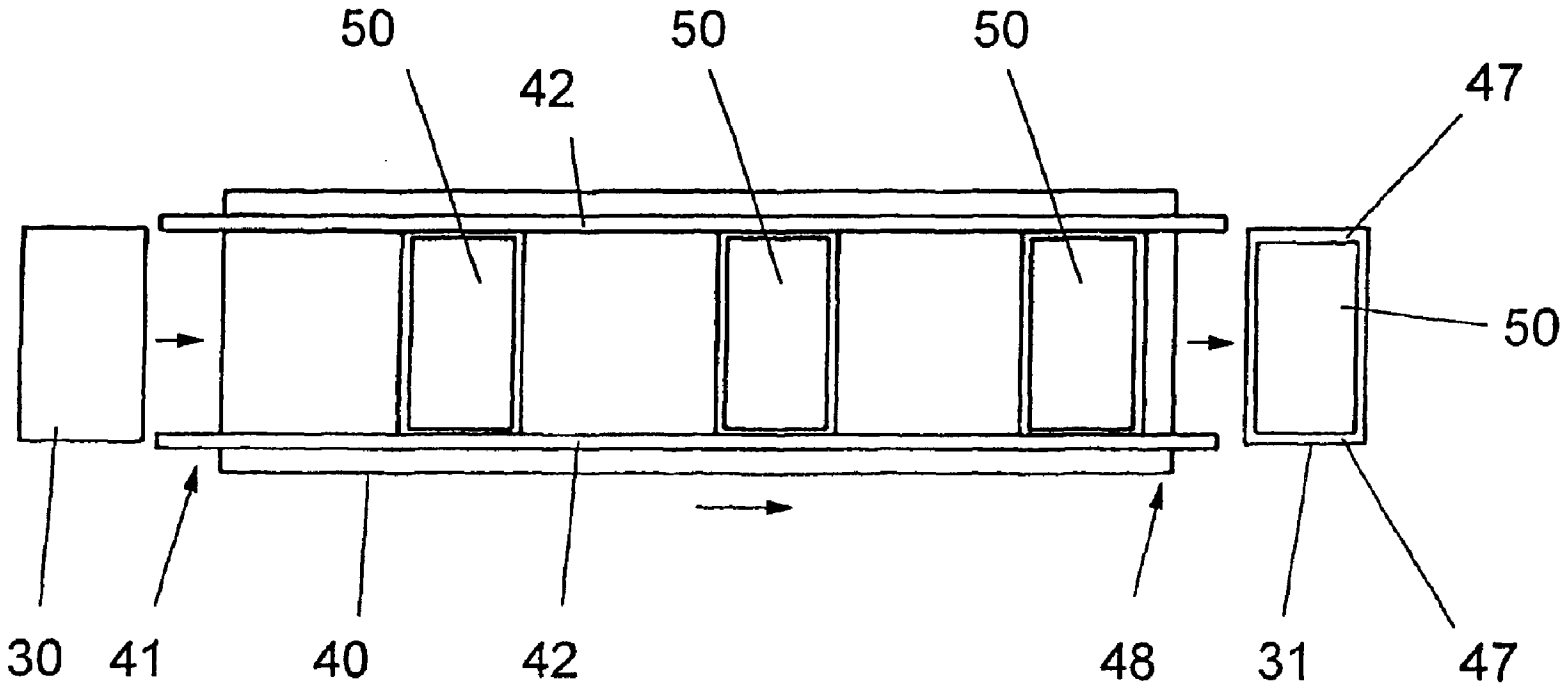
FIG. 5 is a top view of the printing machine shown in FIG. 2.

FIG. 5 shows a top view of the transport path of the sheets 50 of printable matter through the printing machine shown in FIG. 2. The holding bands 42 are placed laterally on the sheets 50 of printable matter. In this case, the sheets 50 are held on edges 47 that are not provided with a print image, while the regions to be printed in the center of the sheets 50 of printable matter remain uncovered. Alternatively, the holding bands 42 could be located in the center of the transport path if non-printed regions are situated at this location in the print image.

Figure 3:
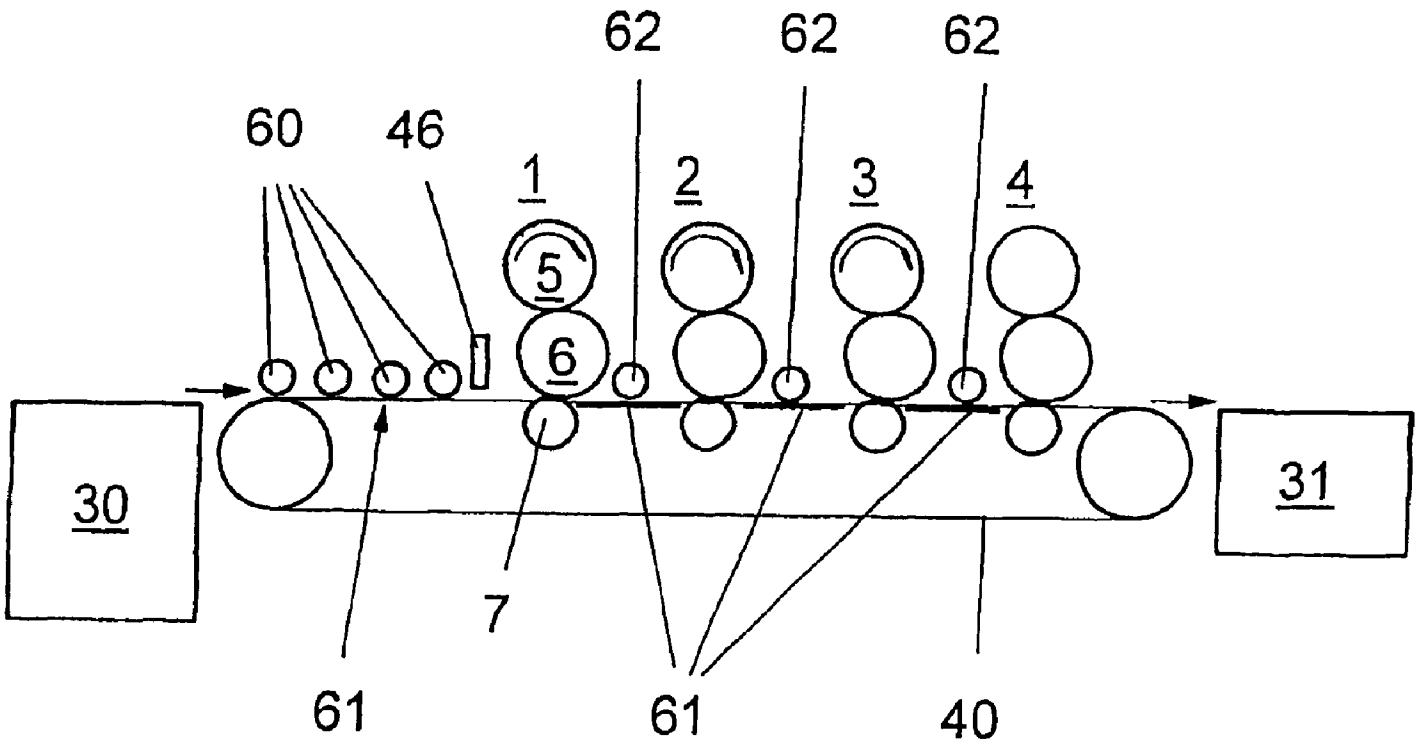
FIG. 3 is a diagrammatic depiction of a printing machine with an alternative embodiment of sheet transport and guiding system in accordance with the invention, in this case utilizing pressing rollers.

FIG. 3 shows a printing machine of the same basic configuration as that shown in FIG. 1. In this case, special conveyor belts 40 are provided with pressing rollers 60 being arranged opposite these conveyor belts. The printable matter is roiled onto the conveyor belts 40 by means of the pressing rollers 60 and fixed thereon in this fashion. The holding force of the conveyor belts 40 relative to the printable matter can be advantageously influenced by choosing the material of the conveyor belts 40 accordingly. Depending on the printable matter, different materials can be used for the conveyor belts 40. The pressing rollers 60 cooperate with a rigid counter or guide surface 61 and serve to exhaust any air situated between the printable matter and the conveyor belt 40. When using film-like materials, it usually suffices to provide an equally smooth conveyor belt 40. In this case, sufficient adhesion is achieved when pressing the printable matter onto the conveyor belt by means of the pressing rollers 60. When processing paper-like printable matter, it is advantageous to provide an adhesive film on the conveyor belt 40 in order to additionally increase the holding force.

With respect to the described configuration, it can be advantageous to effect a charge equalization of the printable matter or to charge the printable matter before it is fed to the first printing unit 1. An electrostatic charging device can be used for this purpose. Before being fed to the first printing unit 1, the position of the printable matter must first be detected and corrected if required. This can be achieved by means of the guidance of the conveyor belt 40. By appropriate belt adjusting means, conveyor belt 40 can be adjusted in the longitudinal and in the lateral direction as it passes through the printing units 1–4.

In order to ensure adhesion to the conveyor belt 40, the printable matter also can be pressed onto the conveyor belt 40 in a correctly registered fashion between the printing units 1–4 by means of additional pressing rollers 62. The guide surfaces 61 provided underneath the conveyor belt 40 serve to achieve an intimate contact with the printable matter. The pressing rollers 62 should be provided with an ink-rejecting surface in this case. However, it also would be possible by means of the pressing rollers 62, to introduce drying substances onto the print image produced on the printable matter.

Figure 4:
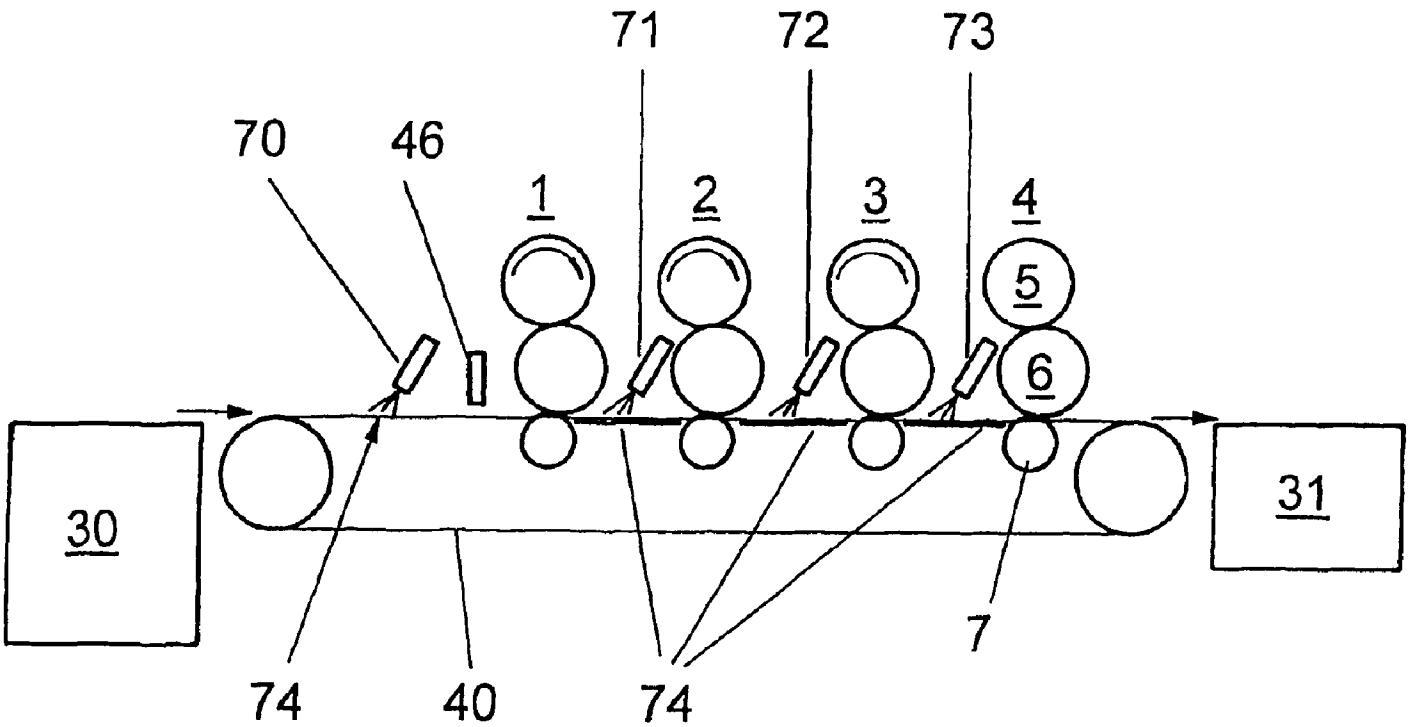
FIG. 4 is a diagrammatic depiction of a printing machine with still another alternative embodiment of sheet transport and guiding system, in this case using pneumatic pressing devices.

FIG. 4 shows another printing machine of the same configuration as that shown in FIG. 1. In this case, the printable matter is held on the conveyor belt 40 by means of an air current. For this purpose, a pneumatic pressing device 70 is provided upstream of the printable matter inlet into the printing zone of the first printing unit 1. This pneumatic pressing device can be in the form of a slot-shaped blower that extends over the entire width of the printable matter. The pneumatic pressing device 70 should be able to generate a very high pressure. It also would be possible for the pneumatic pressing device 70 to move over the printable matter outward from the center. In this case, it may be advantageous to contour the pneumatic pressing device 70 in the transport direction of the printable matter such that, for example, an approximately arrow-shaped arrangement pointing opposite to the transport direction is provided.

Additional pneumatic pressing devices 71, 72 and 73 also are provided for maintaining adhesion between the printing units 1–4. These pressing devices 71–73 make it possible to restore the possibly-diminished adhesion in the printing zones. This is particularly advantageous because the pneumatic pressing devices 71–73 operate in a contactless fashion and consequently cannot smear the fresh print images. An intermediate drying of the print images also can be effected by means of the pneumatic pressing devices 71–73. In this case, it is practical to supply the pneumatic pressing devices 71–73 with pre-heated air.

The adhesion of the printable matter to the conveyor belt 40 can also be increased with additional means, e.g., a detachable adhesive. In this respect, it would be possible to arrange a station for joining the printable matter to the conveyor belt 40 in the feed region of the printable sheets, wherein regions provided with an adhesive bond are arranged in the conveyor belt 40. These regions can be melted with the aid of a heating station to take hold of the surface of the printable matter such that the printable matter adheres particularly well to the conveyor belt. The delivery of the printable matter at the delivery station is achieved by heating the-adhesive regions once again. This type of adhesive bond advantageously makes it possible to join the printable matter and the conveyor belt 40 under conditions that are practically always identical. The alternative and cost-efficient utilization of conventional adhesive strips from which paper-like printable matter can, for example, easily be removed again, is variable as a function of time, and cannot be easily renewed. The option of melting on adhesive regions always provides the same adhesive conditions during transport of the printable matter.

The devices shown also make it possible to process sheet-type printable matter in a printing machine that is configured for web-type printable matter. All variations of attaching the printable matter to the conveyor belt 40 are advantageous with respect to the fact that they always provide identical adhesive conditions. When utilizing electrostatic charges, or if only regions coated with an adhesive are provided, the adhesive conditions cannot be easily renewed. In addition, these options are not suitable for certain printing methods, e.g., the wet offset printing method. The renewability of the adhesive conditions is accomplished, for example, by constant cleaning the adhesive films, thus keeping them free of paper dust. The melt-on adhesive also provides identical adhesive conditions at all times. Adhesion of the printable matter can be constantly monitored, and restored if so required, by means of the pressing rollers 60, 62 and the pneumatic pressing devices 70–73.

The printing machine described can be used for all known printing methods. This means that, in particular, limitation to conventional offset printing does not apply in this case. Also, the transport of the printable matter is not limited to conventional printing methods. On the contrary, it can be utilized in all methods including planographic printing, rotogravure printing and letterpress printing. In this respect, it is possible to carry out direct and indirect printing methods. Digital printing methods in which printing plates are produced in the machine also can be used. Various inking methods can be used in the printing machine, with the orientation taking place according to the required printing quality. Inking methods used in the field of sheet printing can be used with equal success as inking methods known from the field of a web-fed printing. The utilization of special inking methods that are based on toners in dry or liquid form would also be possible, in particular, in digital printing machines.

The printing machine can also be designed in accordance with current construction principles, wherein the utilization of sleeve-shaped printing plates or blankets or other cylinder linings are used.

With respect to the machine configuration, it also would be possible for the cylinders that form the printing gaps to be adjusted relative to one another linearly or in the shape of an arc. This provides the advantage that assignment of the printing elements can be easily effected. In this case, the printing units do not have to be refitted when the printing method or the type of printable matter is changed.

In this context, the utilization of individual drives for all known printing unit elements is particularly advantageous. It would be possible to drive the sheet feeder 30 separately. This enables the transport of sheets of printable matter to the printing machine in a much more targeted fashion.

Printing processes for web-type printable matter that are not dependent on the format can also be used in this case. Printing processes with a not-completely-covered plate cylinder can be controlled in such a way that the web of printable matter is printed over its entire length. In this case, the printable matter can simply be moved in cycles. Although the plate cylinders rotate steadily, the conveyor belt is moved only when a print image needs to be transferred. The conveyor belt is at a standstill when the circumferential sections of the plate cylinder that are not covered with print images rotate past the printable matter. This means that no gaps that would unnecessarily increase the consumption of printable matter are formed between the print images. This method is particularly suitable for a printing process carried out on the previously described printing machine with a conveyor belt. The web of printable matter can be guided very precisely and controlled almost arbitrarily once it is placed onto the conveyor belt. The registration stability of the print images in the individual printing units is always ensured because the conveyor belt guides the web of printable matter. When processing web-type printable matter, the described auxiliary means for producing the connection between the printable matter and the conveyor belt during transport of printable matter can be utilized as described above with reference to sheet-type printable matter.

List of Reference Symbols

Printing unit 1
Printing unit 2
Printing unit 3
Printing unit 4
Plate cylinder 5
Blanket cylinder 6
Impression cylinder 7
Web of printable matter 8
Feed roller 10
Take-off roller 11
Deflection roller 20
Sheet feeder 30
Sheet delivery mechanism 31
Conveyor belt 40
Feed station 41

Holding bands 42
Tensioning device 43
Inlet gap 44
Guide roller 45
Measuring and aligning device 46
Electrostatic device 46
Edge of printable matter 47
Delivery station 48
Sheet of printable matter 50
Pressing rollers 60
Guide surface 61
Pressing roller 62
Pneumatic pressing device 70
Pneumatic pressing device 71
Pneumatic pressing device 72
Pneumatic pressing device 73
Guide surface 74

What is claimed is:

1. A printing machine for printing multicolor print images on printable matter including sheet-type and web-type printable matter, comprising a series of printing units that respectively include at least one plate cylinder, an inking system, a blanket cylinder, and an impression cylinder, a guiding system for transporting and guiding printable matter through each of the printing units (1–4), said impression cylinders (7) of the printing units (1–4) defining a plane that extends linearly through the printing units (1–4) along which the printable matter is moved in a transport path, said guiding system including an endless printing matter transport belt having a segment extending along and past each of the impression cylinders in said linear plane upon which printable matter is conveyed through said printing units, and a printable matter holding belt having a segment parallel to the transport belt segment and extending along and past each of the impression cylinders in said linear plane for holding printable matter on said transport belt during passage through and between said printing units in a manner such that the printable matter is maintained in register with respect to the belt and the blanket cylinders of each printing unit.

2. A printing machine for printing multicolor print images on printable matter including sheet-type and web-type printable matter, comprising a series of printing units that respectively include at least one plate cylinder, an including system, a blanket cylinder, and an impression cylinder, a guiding system for transporting and guiding printable matter through each of the printing units (1–4), said impression cylinders (7) of the printing units (1–4) defining a plane that extends linearly through the printing units (1–4) along which the printable matter is moved in a transport path, said guiding system including an endless belt having a segment extending along and past each of the impression cylinders in said linear plane upon which said printable matter is conveyed through said printing units, and a plurality of printable matter hold down rollers interposed between said printing units for holding printable matter on said endless belt during transfer between said printing units in said linear plane for holding the printable matter on said transport belt such that the printable matter is maintained in register with respect to the belt and the blanket cylinders of each printing unit.

3. A printing machine for printing multicolor print images on printable matter including sheet-type and web-type printable matter, comprising a series of printing units that respectively include at least one plate cylinder, an inking system, a blanket cylinder, and an impression cylinder, a guiding system for transporting and guiding printable matter through each of the printing units (1–4), said impression cylinders (7) of the printing units (1–4) defining a plane that extends linearly through the printing units (1–4) along which the printable matter is moved in a transport path, said guiding system including an endless belt having a segment extending along and past each of the impression cylinders in said linear plane upon which said printable matter is conveyed through said printing units, and a plurality of pneumatic devices interposed between said printing units along said endless belt segment for directing an air stream against printable matter for holding the printable matter against the endless belt during passage through and between said printing units in a manner such that the printable sheet matter is maintained in register with respect to the belt and the blanket cylinders of each printing unit.

4. A printing machine for printing multicolor print images on printable matter, comprising a series of printing units that respectively include at least one plate cylinder, an inking system, a blanket cylinder, and an impression cylinder, a guiding system for transporting and guiding printable matter through each of the printing units (1–4), said impression cylinders (7) of the printing units (1–4) defining a plane that extends linearly through the printing units (1–4) along which the printable matter is moved in a transport path, said guiding system extending along and passed each of the impression cylinders in said linear plane upon which said printable matter is conveyed through said printing units, means for holding said printable matter against said guiding system during passage through and between said printing units in a manner such that the printable sheet matter is maintained in register with respect to the guiding system and the blanket cylinders of each printing unit, and said holding means including a moveable belt having a linearly extending segment disposed above said guiding system and along the impression cylinders of each of the printing units for maintaining printable matter on the guiding system during conveyance through said printing units.

5. The printing machine of claim 4 in which said guiding system includes guiding cylinders that form a gap with said moveable belt and which are adjustable relative to each other.

6. The printing machine of claim 5 which said guiding system-cylinders are adjustable relative to one another for defining the shape of an arc.

7. The printing machine of claim 4 including a feeding station 41 for supplying printable matter to the guiding system and a delivery station for receiving printable matter to the guiding system and a delivery station for receiving printable matter from the guiding system following transport through the printing units.

8. The printing machine of claim 4 including a feed station (41) for feeding printable matter to the guiding system and a delivery system for receiving printable matter from said guiding system following transport through said printing units, said holding means including a device for increasing adhesiveness between the guiding system and printable matter in the vicinity of the feed station, and a device for reducing the adhesiveness of the guiding system relative to printable matter in the vicinity of the delivery station.

9. The printing machine of claim 4 including a drive for said guiding system and a drive for the plate cylinders (5) of the printing units, said guiding system drive being operable independently of the drive for the plate cylinders (5).

10. The printing machine of claim 9 which the plate cylinders have incomplete printing surfaces, said drive for said guiding system is incrementally operated while said drive for said plate cylinders is continuously operated such that substantially continuous printing images can be printed from said incomplete plate cylinder surfaces.

11. A printing machine for printing multicolor print images on printable matter, comprising a series of printing units that respectively include at least one plate cylinder, an inking system, a blanket cylinder, and an impression cylinder, a guiding system for transporting and guiding printable matter through each of the printing units (1–4), said impression cylinders (7) of the printing units (1–4) defining a plane that extends linearly through the printing units (1–4) along which the printable matter is moved in a transport path, said guiding system extending along and passed each of the impression cylinders in said linear plane upon which said printable matter is conveyed through said printing units, means for holding said printable matter against said guiding system during passage through and between said printing units in a manner such that the printable sheet matter is maintained in register with respect to the guiding system and the blanket cylinders of each printing unit, and said holding means including rollers disposed between said printing units above the guiding system and moving printable matter for maintaining the printable matter on the guiding system.

12. A printing machine for printing multicolor print images on printable matter, comprising a series of printing units that respectively include at least one plate cylinder, an inking system, a blanket cylinder, and an impression cylinder, a guiding system for transporting and guiding printable matter through each of the printing units (1–4), said impression cylinders (7) of the printing units (1–4) defining a plane that extends linearly through the printing units (1–4) along which the printable matter is moved in a transport path, said guiding system extending along and passed each of the impression cylinders in said linear plane upon which said printable matter is conveyed through said printing units, means for holding said printable matter against said guiding system during passage through and between said printing units in a manner such that the printable sheet matter is maintained in register with respect to the guiding system and the blanket cylinders of each printing unit, and said holding means including pneumatic devices between said printing units above said guiding system for directing a pneumatic stream against the printable matter.

* * * * *